US005906118A

United States Patent [19]

Cho et al.

[11] Patent Number: 5,906,118

[45] Date of Patent: May 25, 1999

[54] CLOTHES WASHING MACHINE HAVING A REINFORCED PULSATOR

[75] Inventors: Min-Su Cho, Inchun; Kyoung-Weon Park, Seoul, both of Rep. of Korea

[73] Assignee: Samsung Electronics Co., Ltd., Suwon-City, Rep. of Korea

[21] Appl. No.: 09/050,132

[22] Filed: Mar. 30, 1998

[51] Int. Cl.[6] ..... D06F 17/10

[52] U.S. Cl. ..... 68/53; 68/134

[58] Field of Search ..... 68/53, 134

[56] References Cited

U.S. PATENT DOCUMENTS

| | | | |
|---|---|---|---|
| 2,722,118 | 11/1955 | Guthrie | 68/134 |
| 4,420,952 | 12/1983 | Brenner et al. | 68/53 |
| 5,829,276 | 11/1998 | Suh et al. | 68/53 |
| 5,839,300 | 11/1998 | Yoon et al. | 68/134 |

FOREIGN PATENT DOCUMENTS

| | | | |
|---|---|---|---|
| 229276 | 10/1996 | Japan | 68/53 |

*Primary Examiner*—Philip R. Coe

*Attorney, Agent, or Firm*—Burns, Doane, Swecker & Mathis, L.L.P.

[57] ABSTRACT

A clothes washing machine has a washing water spurting apparatus for spurting washing water directly upwardly from a center of a pulsator. The washing water is guided by at least guide one duct affixed to the pulsator. The pulsator has a plurality of first ribs formed on an underside of the pulsator and second ribs formed in recesses of the lower surface of the underside. Each of the first ribs is spaced a predetermined distance from the inlet of the guide duct. Each of the second ribs has a height extending from the underside of the pulsator, which is smaller than a height of a top border of the inlet. The first and second ribs enable the washing water to flow smoothly into the inlet of the guide duct when the pulsator rotates. The pulsator and the rotating blades are prevented from being deformed by the presence of the ribs.

5 Claims, 6 Drawing Sheets

CLOTHES WASHING MACHINE HAVING A REINFORCED PULSATOR

BACKGROUND OF THE INVENTION

1) Field of the Invention

The present invention relates to a clothes washing machine, and more particularly to a washing machine having a spin basket in which a pulsator is mounted for rotation.

2) Prior Art

Generally, a clothes washing machine is an appliance for washing laundry, in which a pulsator rotates to generate washing current for applying impact to the laundry, thereby washing the laundry.

FIG. 1 shows such a conventional washing machine. As shown, the conventional washing machine includes a housing 10 forming the outer appearance of the washing machine, a tub 11 installed in the housing 10 for containing a predetermined amount of washing water required for washing the laundry, and a spin basket 12 rotatably installed in the tub 11. A pulsator 13 for generating the washing current is mounted on the inner bottom of the spin basket 12, and a driving mechanism 14 for driving the spin basket 12 and the pulsator 13 is arranged under the tub 11. The driving mechanism 14 includes a motor 14*a* and a transmission 14*b*. The motor 14*a* generates the driving power, and the transmission 14*b* selectively drives the pulsator 13 and the spin basket 12 by means of the rotating force of the motor 14*a* transferred through a belt 14*c*.

Further, a drain hose 15 is provided at one side position under the tub 11 and extends out of the housing 10 to drain the washing water from the tub 11.

In the conventional washing machine as constructed above, when an electric power is applied after the laundry is put in the spin basket 12, the washing water is supplied into the spin basket 12 and then the pulsator 13 is rotated in one direction or alternately in opposite directions (i.e., oscillated) by the motor 14*a* to generate the washing current. The laundry flows according to the washing current and is washed by the friction occurring between the clothes and the washing water and the inner wall of the spin basket 12.

However, in such a conventional washing machine, the laundry usually becomes tangled together above the center of the pulsator to thereby diminish the washing performance. That is, the centrifugal force caused by the rotation of the pulsator drives the washing water toward the wall of the spin basket. As a result, the washing water is deeper at the outer periphery of the pulsator, than at the center thereof. Therefore, the clothes come into closer contact above the center of the pulsator. Such gathered laundry above the center of the pulsator goes on rotating in one direction or alternately in opposite directions along with the pulsator, so that the laundry becomes severely tangled together, thereby diminishing the washing performance of the washing machine and even damaging the laundry.

SUMMARY OF THE INVENTION

The present invention has been made to overcome the above described problems of the prior art, and accordingly it is an object of the present invention to provide a washing machine, in which washing water spurts upwardly from the center of a pulsator, so as to disperse the laundry gathered thereabove.

It is another object of the present invention to provide a clothes washing machine having a washing water spurting apparatus, which enables the washing water to be introduced thereinto and spurted out therefrom easily and smoothly.

To achieve the above object, the present invention provides a washing machine comprising:

a housing;

a spin basket mounted in the housing;

a pulsator rotatably mounted at a bottom of the spin basket, the pulsator including a rotating plate, a plurality of rotary blades, and a plurality of first ribs, the rotating blades protruding upwardly from an upper surface of the rotating plate, the first ribs being disposed on an underside of the pulsator so as to prevent the pulsator from being deformed; and a washing water spurting apparatus assembled with the pulsator, the washing water spurting apparatus including at least one guide duct, and a spurt cap, the guide duct having a radially outer inlet and a radially inner outlet for guiding washing water from the inlet to the outlet adjacent a center of the pulsator, the spurt cap directing upwardly the washing water ejected from the guide duct at the center of the pulsator, wherein each of the first ribs is spaced by at least a predetermined distance from the inlet of the guide duct.

BRIEF DESCRIPTION OF THE DRAWINGS

The above object, and other features and advantages of the present invention will become more apparent by describing preferred embodiments thereof in detail with reference to the attached drawings, in which:

FIG. 6*a* is an enlarged view of a circled portion of a second rib disposed on the underside of the pulsator; and FIG. 6*b* is an enlarged view of a circled portion of a top border of a duct inlet.

DESCRIPTION OF A PREFERRED EMBODIMENT

Hereinafter, a preferred embodiment of the present invention will be described in detail with reference to the accompanying drawings, and like elements will be numbered the same in the following description.

Figure 1:
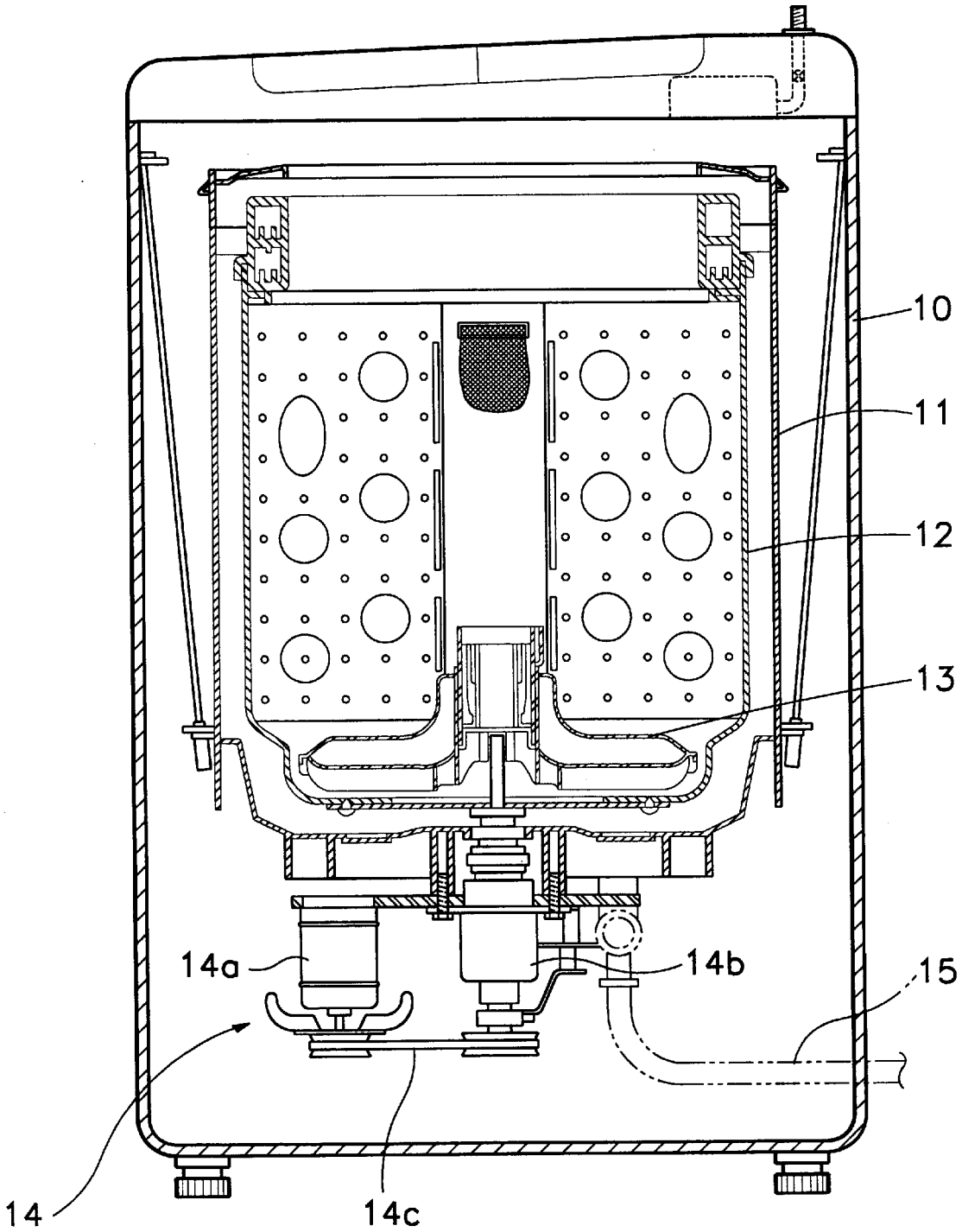
FIG. 1 (PRIOR ART)
FIG. 1 is a sectional view of a conventional washing machine for showing the inner construction thereof.
Figure 2:
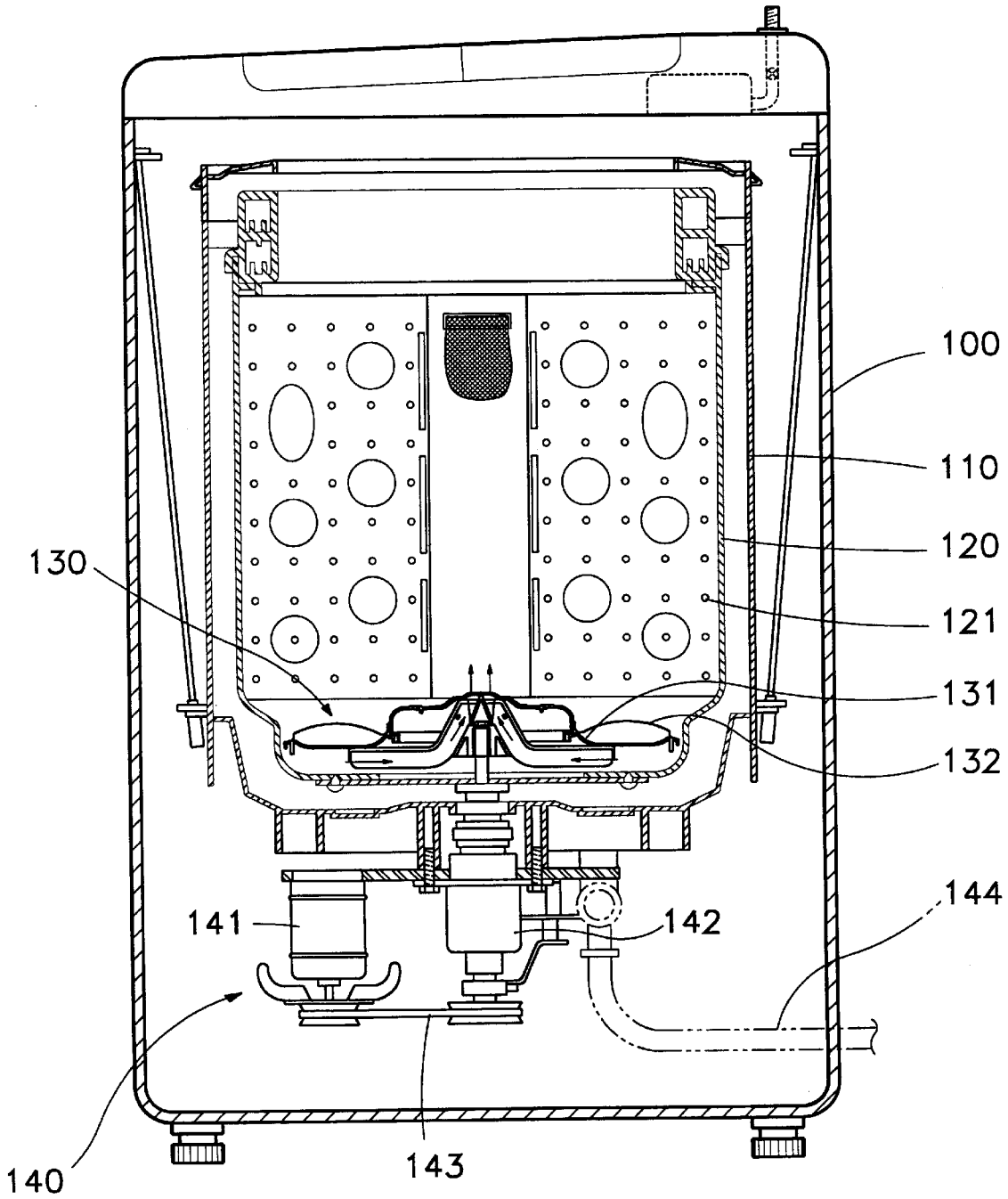
FIG. 2 is a sectional view of a washing machine according to an embodiment of the present invention, which shows the inner construction thereof.

FIG. 2 is a sectional view of a preferred embodiment of a washing machine according to the present invention, for showing the inner construction thereof.

As shown, the washing machine according to the present invention has a housing 100 forming the outer appearance of the washing machine. A control section (not shown) is arranged in an upper portion of the housing 100, and a tub 110 for containing the washing water is mounted in the housing 100. A spin basket 120 formed with a plurality of holes 121 is rotatably installed in the tub 110. On the bottom of the spin basket 120 is installed a pulsator 130 which includes a rotating plate 131 carrying a plurality of blades 132 arranged radially and protruding upward from the upper surface of the rotating plate 131. The pulsator 130 generates the washing current when it rotates in one direction or alternately is oscillated in opposite directions.

A driving mechanism 140 for driving the spin basket 120 and the pulsator 130 is arranged under the tub 110. The driving mechanism 140 includes a motor 141 and a transmission 142. The motor 141 produces the driving power, and the transmission 142 selectively rotates the pulsator 130 and the spin basket 120 by means of the rotating force of the motor 141 transferred through a belt 143. The transmission 142 rotates either the pulsator 130 alone, when the laundry is being washed, or it rotates the spin basket 120 and the pulsator 130 together when the laundry is being dehydrated (spin-drying). A drain hose 144 is provided at one side position under the tub 110 and extends out of the housing 100 to drain the washing water from the tub 110.

The pulsator 130 further includes a washing water spurting apparatus for spurting (ejecting) the washing water upwardly from the center of the pulsator to thereby prevent the laundry from being gathered and tangled.

Figure 3:
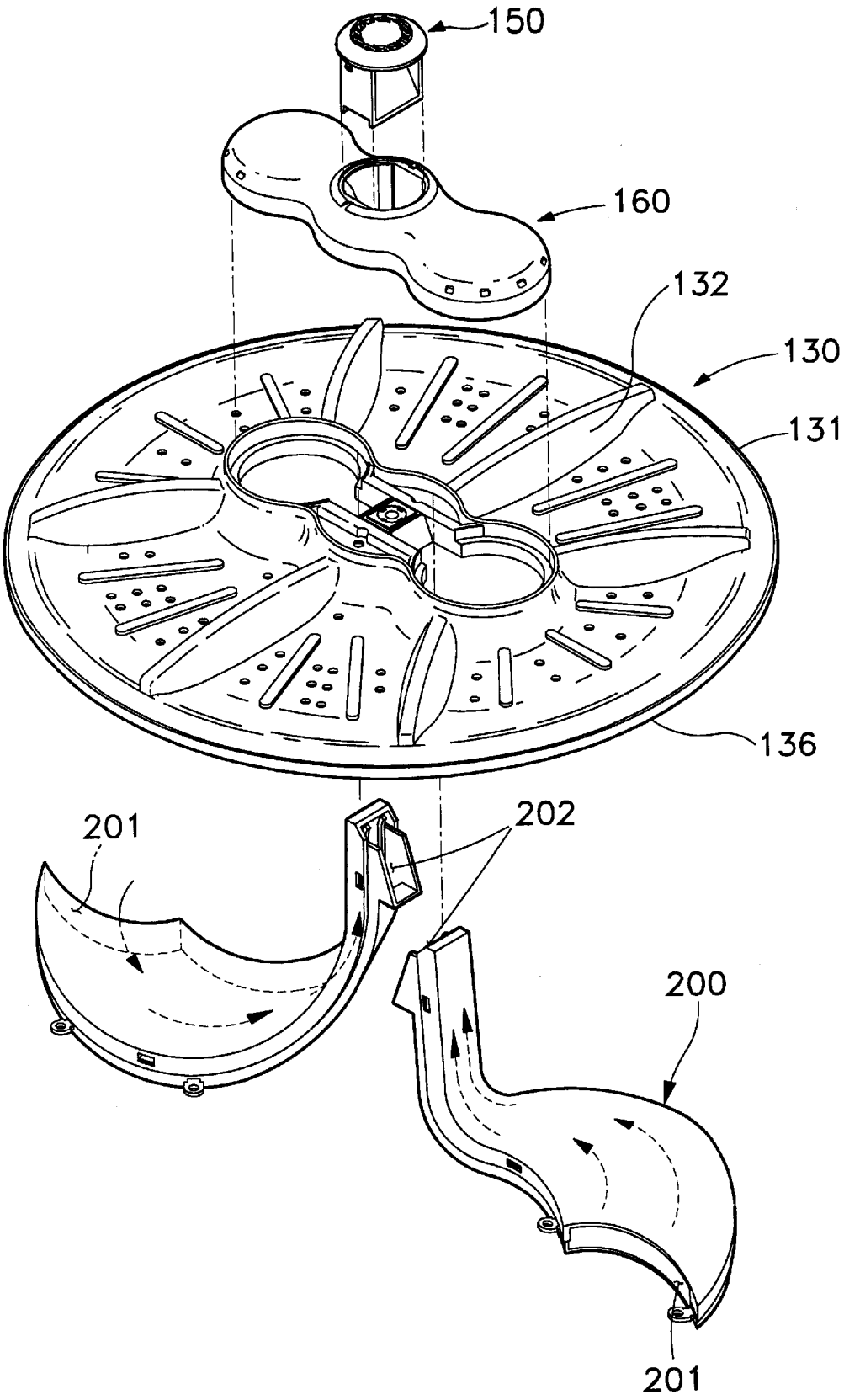
FIG. 3 is an exploded perspective view of a pulsator and a washing water spurting apparatus installed to the pulsator, which are employed in the washing machine shown in FIG. 2.

FIG. 3 is an exploded perspective view for showing in detail the construction of the pulsator and the washing water spurting apparatus according to the present invention.

The washing water spurting apparatus includes a guide duct 200 and a spurt cap 150. The guide duct 200 is fixed to the underside of the pulsator 130 so as to rotate together with the pulsator 130, thereby receiving washing water and guiding the washing water to the center of the pulsator 130. The spurt cap 150 is disposed at the center of the pulsator 130, so as to upwardly direct the washing water, guided by the guide duct 200, to a location above the center of the pulsator 130.

Although the washing water spurting apparatus may include only one guide duct 200, it is preferable to provide a pair of guide ducts 200 fixed to the pulsator 130 in opposing relationship to each other, in consideration of the space available for locating the guide ducts 200 and the need to keep the pulsator 130 dynamically balanced.

Each guide duct 200 has an inlet 201 formed at a radially outer end thereof and an outlet 202 formed at a radially inner end thereof. When the pulsator 130 rotates, the washing water is caused to enter the guide duct 200 through the inlet 201, and exit the guide duct 200 through the outlet 202 in an upward direction at the center of the pulsator 130. The cross sectional area of the guide duct 200 gradually decreases from the inlet 201 to the outlet 202, so that the flowing speed of the washing water increases as it goes from the inlet 201 to the outlet 202, whereby a strong upward spurt of the washing water occurs at the outlet 202. Further, the inlet 201 of the guide duct 200 faces in a horizontal direction, while the outlet 202 thereof faces upwardly.

Reference numeral 160 designates a supplementary blade. The spurt cap 150 is affixed to the supplementary blade 160, and the supplementary blade 160 rotates together with the pulsator 130 to make the vortex of the water current more violent.

Figure 4:
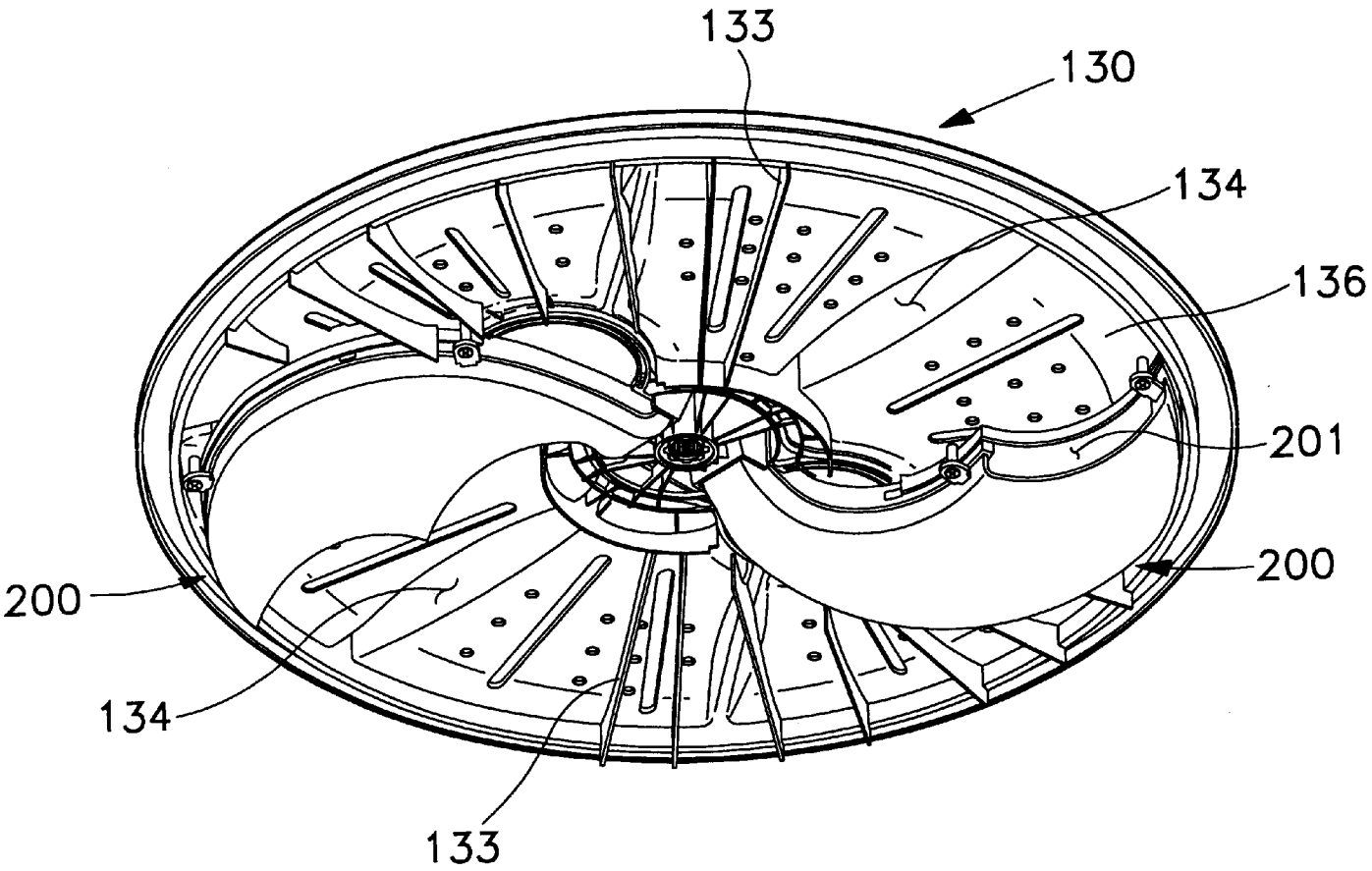
FIG. 4 is a perspective view of the pulsator with guide ducts of the washing water spurting apparatus shown in FIG. 3.
Figure 5:
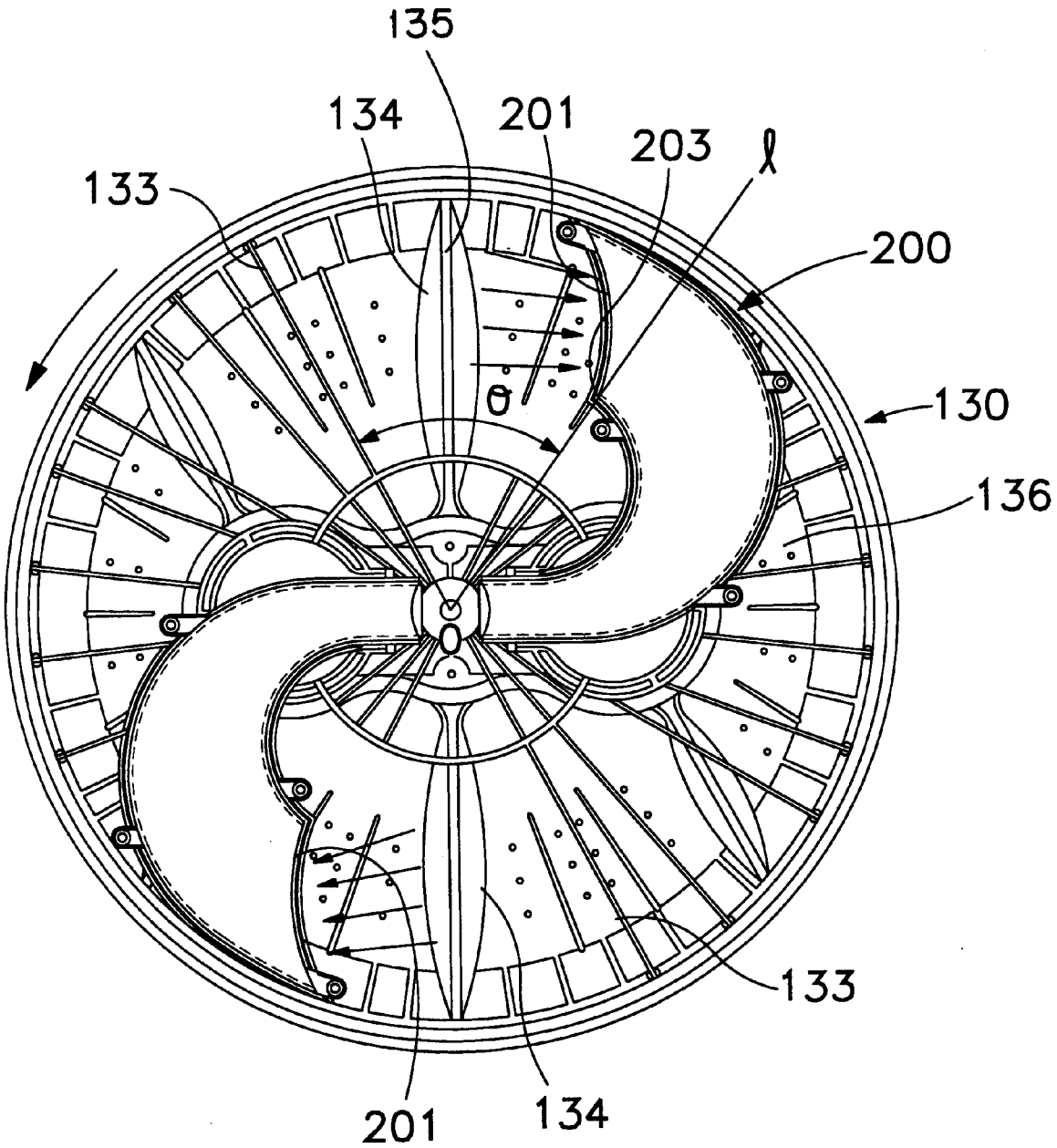
FIG. 5 is a bottom view of the pulsator shown in FIG. 4.

FIGS. 4 and 5 are respectively a bottom perspective view and a bottom plan view of the pulsator having guide ducts of the washing water spurting apparatus shown in FIG. 3, which are assembled with the pulsator.

As shown, a plurality of first ribs 133 for reinforcing the pulsator 130 to prevent deformation of the pulsator 130 are arranged at regions of the lower surface 136 of the pulsator 130 not occupied by the guide ducts 200. The first ribs 133 extend radially outward from the center of the pulsator 130. It is preferred that all of the first ribs 133 be spaced a predetermined distance from the inlet 201 so as to enable the washing water to be smoothly introduced into the inlet 201 and at the same time to optimize the spurting quantity and the spurting height of the washing water ejected out of the spurt cap 150. More preferably, as shown in FIG. 5, each of the ribs 133 is arranged to make at least an angle θ of about 75 degrees with respect to a normal line extending through a radially inner corner 203 of the inlet 201 of each guide duct 200 from the center 0 of the pulsator 130.

Figure 6:
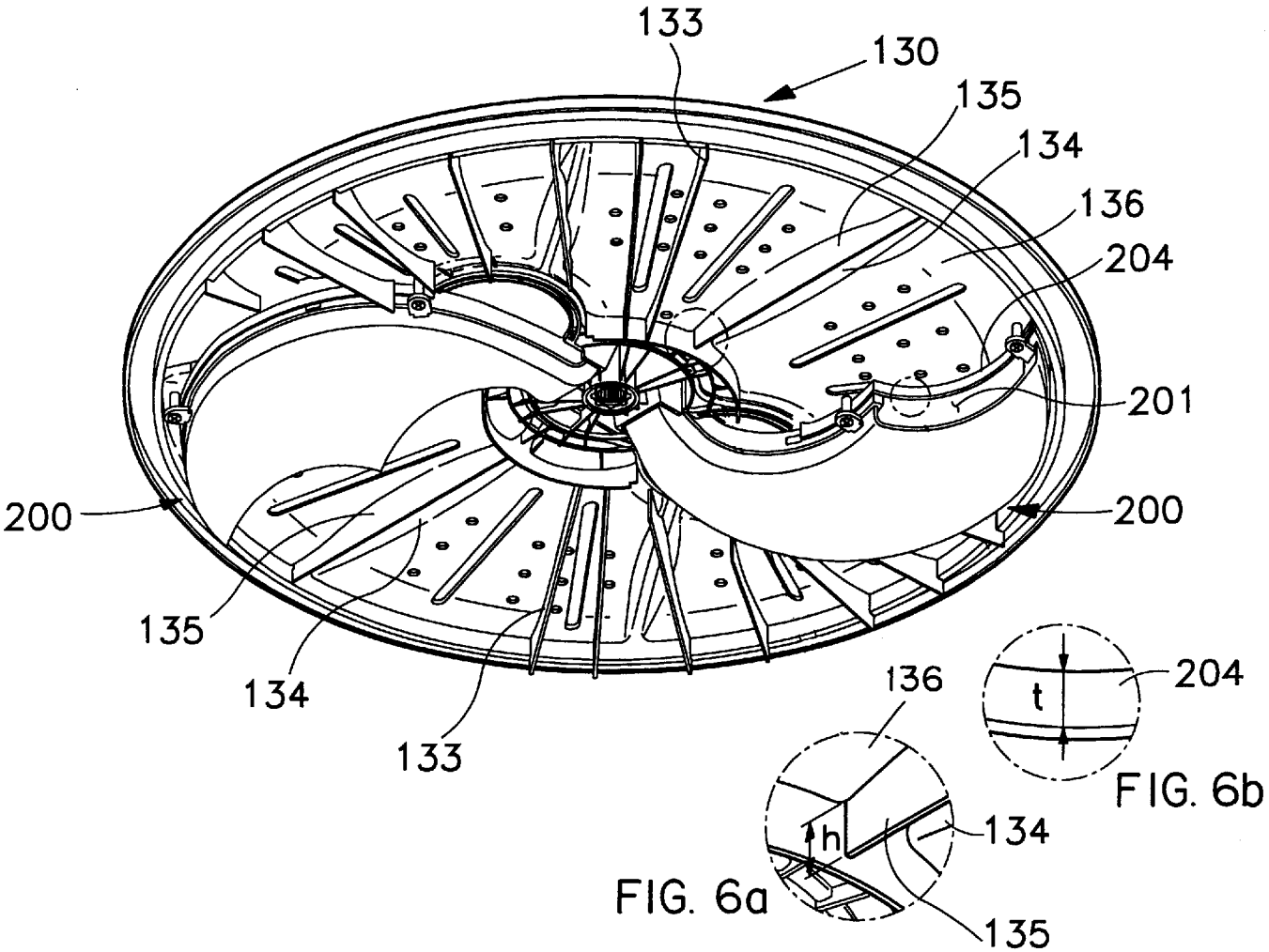
FIG. 6 is an underside perspective view of the pulsator of FIG. 4, which shows ribs provided at the pulsator to reinforce the pulsator.

FIG. 6 is a bottom perspective view of the pulsator of FIG. 4, which shows second ribs 135 provided on an underside of the pulsator to further reinforce the pulsator.

Radially extending recesses 134 (see FIG. 4) are formed in the underside 136 of the pulsator 130 due to the formation of the rotating blades 132 (see FIG. 3). That is, the recesses 134 constitute hollow interiors of the blades 132. The second ribs 135 prevent deformation of the rotating blade 132 an are disposed in respective recesses 134. Since the first ribs 133 (for preventing the deformation of the pulsator 130) are spaced a predetermined distance apart from the inlets 201 of respective ducts 200 so as to enable a smooth inflow of washing water into the inlet 201 as described above, the construction of the pulsator 130 is correspondingly weakened. To overcome this problem, each second rib 135 is provided in a respective one of the recesses 134 and accordingly is located between a first rib 133 and the inlet 201 of a respective guide duct 200 as shown in FIG. 6.

Meanwhile, the second rib 135 protrudes downward from the bottom of the recess 134 beyond the lower surface 136 of the pulsator 130. The height h (FIG. 6*a*) of the second rib 135 from the lower surface 136 of the pulsator 130 is not larger than the height t of a top border 204 of the front of each inlet 201 of the guide duct 200. Otherwise, if the height h were larger than the height t, the second rib 135 would disturb a smooth inflow of washing water into the guide duct 200 through the inlet 201 when the pulsator 130 rotates. Such a disturbance would hinder the operation of the washing water spurting apparatus.

Referring to FIGS. 2, 3 and 5, the operation of the washing machine as constructed above will be described hereinafter.

First, when the washing machine is driven by operating the control section (not shown) after putting laundry in the spin basket 120, the washing water is introduced into the spin basket 120 and simultaneously into the guide duct 200. Thereafter, an electric power is applied to the motor 141, whereupon the transmission 142 rotates the pulsator 130 in one direction or alternately oscillates the pulsator in opposite directions by means of the rotating force transferred from the motor 141. In this case, the guide duct 200 fixed to the lower surface 136 of the pulsator 130 rotates together with the pulsator 130. When the pulsator 130 rotates counterclockwise as shown in FIG. 5, the washing water continuously flows into the guide duct 200 through the inlet 201 due to the rotating force of the pulsator 130. The washing water introduced into the guide duct 200 as described above goes on flowing in the guide duct 200 and then spurts upwardly from the center of the pulsator 130 through the outlet 202. In the meantime, as described above, since the cross sectional area of the guide duct 200 narrows from the inlet 201 to the outlet 202, the washing water flows gradually faster to eventually achieve a strong spurt through the outlet 202 and the spurt cap 150. Therefore, the laundry gathered above the center of the pulsator 130 during the washing can be dispersed by the strong spurt of the washing water.

As described above, the washing machine according to the present invention includes a washing water spurting apparatus for guiding and spurting the washing water upwardly from the center of the pulsator. The washing water spurting apparatus disperses the laundry gathered above the center of the pulsator to thereby preventing the laundry from being tangled and damaged, and at the same time the spurting washing water applies an impact to the laundry to thereby improve the washing performance of the washing machine.

The washing machine is further advantageous in that the washing water can flow smoothly into the inlet of the guide duct when the pulsator rotates, since the first ribs provided at the lower surface of the pulsator are spaced apart from the inlet.

Furthermore, in the washing machine, the pulsator and the rotating blades are prevented from being deformed by virtue of the second ribs disposed between the first ribs and the inlets of the guide ducts.

While the present invention has been particularly shown and described with reference to the particular embodiment thereof, it will be understood by those skilled in the art that various changes in form and details may be effected therein without departing from the spirit and scope of the invention as defined by the appended claims.

What is claimed is:

1. A clothes washing machine comprising:

a housing;

a spin basket mounted in the housing;

a pulsator rotatably mounted at a bottom of the spin basket, the pulsator including a rotating plate, a plurality of rotary blades, and a plurality of first ribs, the rotary blades protruding upward from an upper surface of the rotating plate, the first ribs being disposed on an underside of the pulsator so as to prevent the pulsator from being deformed; and a washing water spurting apparatus assembled with the pulsator, the washing water spurting apparatus including at least one guide duct and a spurt cap, the guide duct having a radially outer inlet and a radially inner outlet for guiding washing water from the inlet to the outlet adjacent a center of the pulsator, the spurt cap directing upwardly the washing water ejected from the guide duct from the center of the pulsator, wherein each of the first ribs is spaced by at least a predetermined distance from the inlet of the guide duct.

2. The clothes washing machine as claimed in claim 1, wherein the first ribs extend radially outward from the center of the pulsator, and each of the ribs is arranged to make an angle of about 75 degrees with respect to a normal line extending through an inner corner of the inlet of the guide duct from the center of the pulsator.

3. The clothes washing machine as claimed in claim 1, wherein the underside of the pulsator further comprises second ribs for preventing the rotating blades from being deformed.

4. The clothes washing machine as claimed in claim 3, wherein each of the second ribs is provided in respective recesses which constitute hollow interiors of the rotary blades.

5. The clothes washing machine as claimed in claim 4, wherein each of the second ribs protrudes downward from a bottom of each of the recesses beyond the underside of the pulsator, and each of the second ribs has a first height extending downwardly from the undersurface of the pulsator, the first height being smaller than a second height defined by a top border of the inlet.

* * * * *